US008714504B2

(12) United States Patent
Vuorenoja

(10) Patent No.: US 8,714,504 B2
(45) Date of Patent: May 6, 2014

(54) ARRANGEMENT FOR MOUNTING A SUPPORT BASE ON A WALL

(75) Inventor: Ari-Matti Vuorenoja, Turku (FI)

(73) Assignee: Frestems Oy (FI)

( * ) Notice: Subject to any disclaimer, the term of this patent is extended or adjusted under 35 U.S.C. 154(b) by 0 days.

(21) Appl. No.: 13/124,666

(22) PCT Filed: Oct. 16, 2009

(86) PCT No.: PCT/FI2009/000090

§ 371 (c)(1),
(2), (4) Date: Apr. 18, 2011

(87) PCT Pub. No.: WO2010/043753

PCT Pub. Date: Apr. 22, 2010

(65) Prior Publication Data

US 2011/0198463 A1 Aug. 18, 2011

(30) Foreign Application Priority Data

Oct. 17, 2008 (FI) ..... 20080580

(51) Int. Cl.
*E04G 3/00* (2006.01)

(52) U.S. Cl.
USPC ..... 248/285.1; 248/299.1; 5/507; 5/508

(58) Field of Classification Search
USPC ..... 248/118, 118.3, 235, 240.3, 285.1, 248/299.1
See application file for complete search history.

(56) References Cited

U.S. PATENT DOCUMENTS

| | | | | |
|---|---|---|---|---|
| 1,706,634 | A * | 3/1929 | Seils | 297/411.22 |
| 2,690,794 | A * | 10/1954 | Ahern | 296/153 |
| 5,908,221 | A * | 6/1999 | Neil | 297/411.36 |
| 7,487,943 | B1 * | 2/2009 | Gillespie | 248/282.1 |

* cited by examiner

*Primary Examiner* — Gwendolyn Baxter
(74) *Attorney, Agent, or Firm* — Galbreath Law Offices, P.C.; John A. Galbreath

(57) ABSTRACT

Arrangement for attaching a base (10), a tray, a platform or a similar support to a wall with the help of turning arms (4), (5) attached to the mentioned wall in which case the mentioned base can be moved with the help of the arms (4), (5). The base can be moved outwards from the wall in horizontal direction at the first stage of the moving in which case the first arm (4) and the second arm (5) of the arms are both hinged to be turning out of the wall in horizontal direction and the mentioned base (10) is attached to the moveable ends of the arms (4), (5) and that in the arrangement when the moving of the base (10) sideways is further continued, an elevation adjustment bar (7) belonging to the second arm (5) and sliding in the height direction is arranged to slide downwards and at the same time to set the support elements of the base (10) lower at the location of the second arm (5) in order to achieve a tilted position for the base (10).

8 Claims, 2 Drawing Sheets

ARRANGEMENT FOR MOUNTING A SUPPORT BASE ON A WALL

BACKGROUND OF THE INVENTION (1) Field of the Invention

The invention relates to an arrangement in order to attach a base, a tray, a platform or a similar support on a wall with the help of turning arms that are attached to the above mentioned wall in which case the above mentioned base can be moved with the help of the arms.

(2) Description of Related Art

Previously it is known mechanisms which can be attached to a wall according to the above mentioned preamble wherein by means of which mechanisms said bases or trays that are located next to the wall have been moved further away from the wall and possibly have been locked to this position by locking the hinges or the arms with a known method to a certain turning angle. This kind of solutions are known for example in the ambulance vehicles in which case a stretcher supported by the base are organised next to the wall and correspondingly away from the wall farther out for a nursing action. In these cases the moving of the patient on the stretcher onto the base located in the vehicle and correspondingly away from the base and out is a difficult procedure in which at least two persons, who can still lift relatively large loads, are needed.

In the publication DE 1161386 B a base that is attached to the wall with the help of turning arms is shown. The base can be moved away from the wall by turning the arms. One of the arms has been hinged to be turning around the vertical axis in which case the head of the arm maintains its altitude during the turning movement. Another arm is hinged to be turning around deviating from the vertical direction in which case the head of its arm begins to move to a lower position when the turning angle of the arm is increased. The base attached to the arm of this head also immediately starts to move down at the same time the consequence of which is the fact that the base tilts the more, the more the arms are turned away from the wall. With this arrangement it is not possible to achieve such a nursing position of the patient on the base where the base would have been pulled away from the wall and where the base would still have a landscape orientation.

BRIEF SUMMARY OF THE INVENTION

In order to solve the above mentioned problem a new arrangement has been developed in order to attach the base to the wall in which case for example a patient lying on the stretcher is easy to move supported by the base and away from it or correspondingly loadings occuring on this kind of base are easy to perform in other applications. A significant advantage is the fact that the patient lying on the base can be treated on both sides of the base because with the help of the arrangement it is possible to draw the base off the wall when it still has the landscape orientation and lock the base to be immovable at that location.

For the arrangement according to the invention in which arrangement a base, a tray, a platform or a similar support can be moved to essentially most advantageous positions it is characteristic for the loading that the base can be moved from the wall in horizontal direction outwards at the first stage of the moving in which case both the first arm of the arms and the second arm have been hinged to turn in horizontal plane out of the wall and the mentioned base is attached to the moveable ends of the arms and that when in the arrangement one further continues to move the base sideways, an elevation adjustment bar belonging to the second arm and sliding in height direction is arranged to slide downwards and at the same time to set the support elements of the base lower at the location of the second aim in order to the create a slanted position for the base.

The advantage of the invention is the fact that the base that can be moved next to the wall is easy to move with the load or without it and also easy to move from the wall and to make come down to a better loading position and also in the vehicle cases partly also out of the door in such a way that the loading supported by the base becomes considerably easier. The base can be locked to various locations—if needed—for example a little bit from the wall to an out pulled position in which case the base still has the same direction as the wall.

BRIEF DESCRIPTION OF THE DRAWINGS

In the following the invention is described more detailed by referring to the accompanying drawing in which.

DETAILED DESCRIPTION OF THE INVENTION

Figure 1:
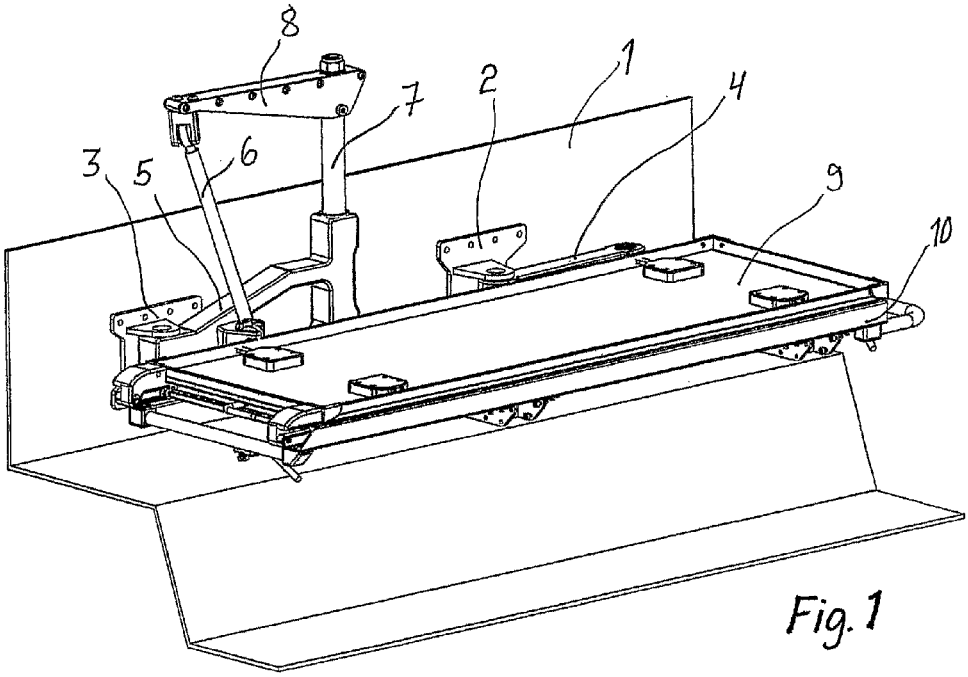
FIG. 1 shows a stretcher base that can be attached to the wall of the vehicle which base has the position that is nearest to the wall.

In the FIG. 1 there is a movable carriage 9 and a stretcher base 10 that is attached to the wall 1 of the vehicle with the help of attachment fixtures 2 and 3 which stretcher base 10 is adjusted to be moveable with the help of the first arm 4 and the second arm 5 that turn supported by the hinges. The arms 4 and 5 are being turned next to the wall 1 in which case the stretcher base 10 is next to the wall.

Figure 2:
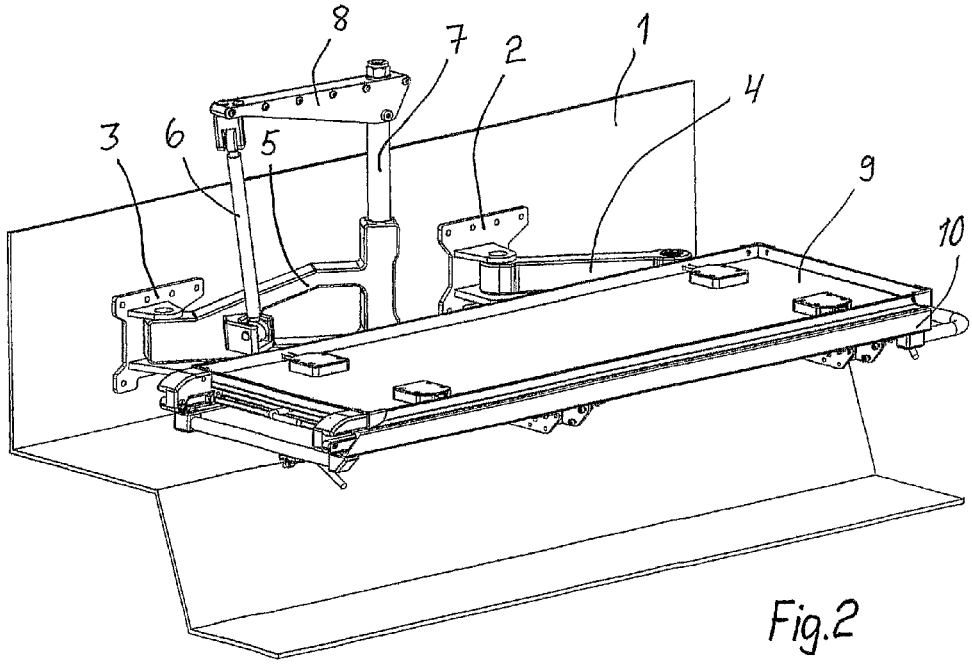
FIG. 2 shows the stretcher base of the FIG. 1 being moved a little bit from the wall.

In the FIG. 2 the arms 4 and 5 are a little bit turned away out of the wall in which case also the stretcher base 10 has moved a little bit from the wall. The base has moved in horizontal direction out of the wall.

Figure 3:
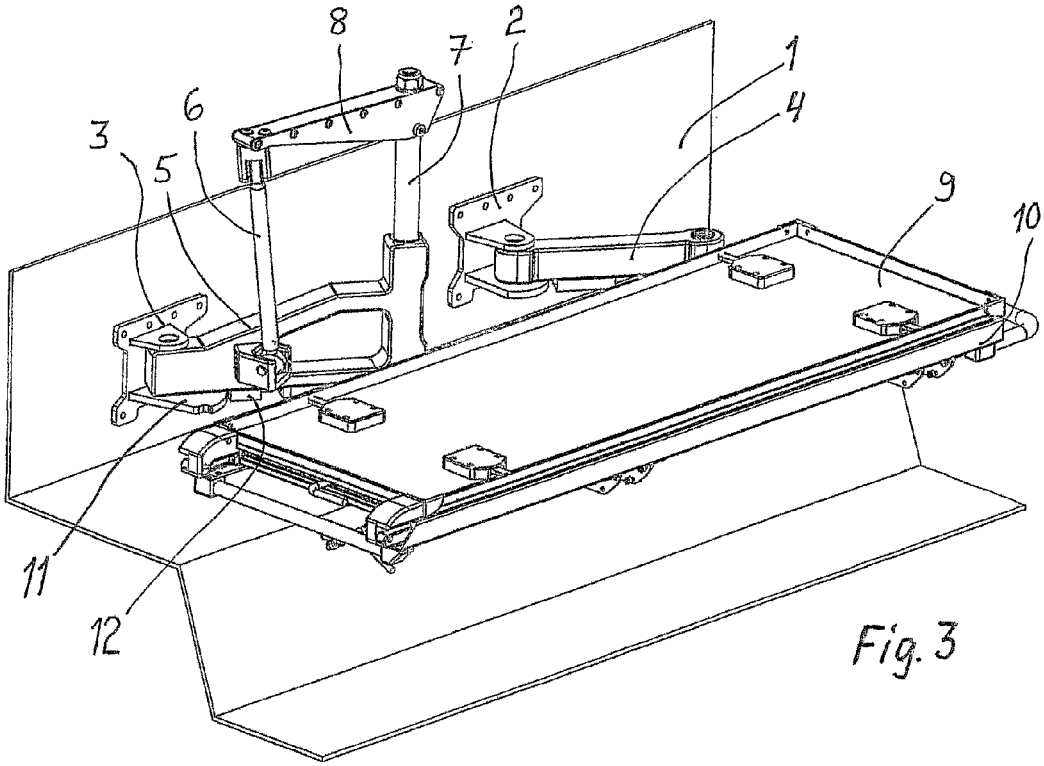
FIG. 3 shows the stretcher base of the FIG. 1 being moved from the wall to a nursing position.

In the FIG. 3 the stretcher base 10 has moved so much out of the wall 1 in horizontal direction that it has reached a position in relation to the lengths of the first arm 4 and the second arm 5 and also regarding the distances of the pivots of their arms from the wall 1 in which position it has the direction of the wall and has essentially the same height as it had next to the wall when it was at the start situation.

In this position the locking of the base to this position belongs to this arrangement which locking is realised with the help of the sector plate 11 attached to the attachment element 3 and with the help of a interlocking bolt 12 that is protruded to its hole in this position. This position is an advantageous nursing position of a patient when such thing is performed in the vehicle.

Figure 4:
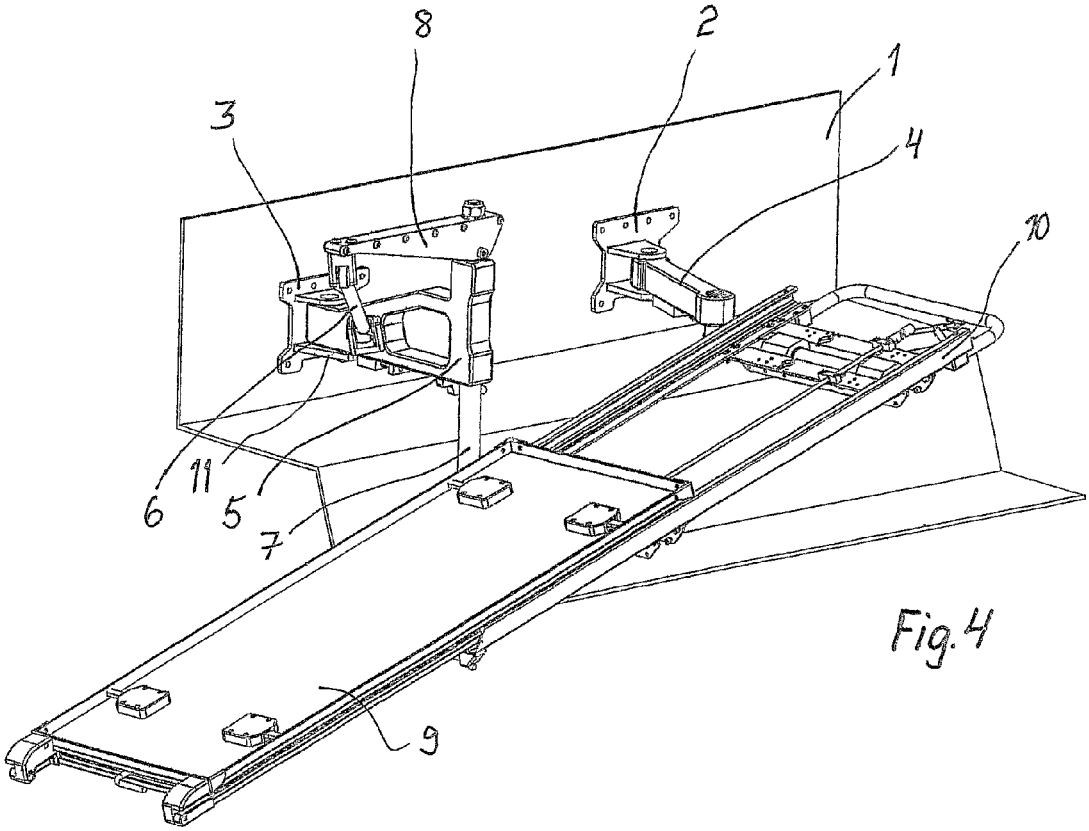
FIG. 4 shows the stretcher base of the FIG. 1 in the loading position.

In the FIG. 4 there is a situation where the stretcher base 10 has been moved for example by pulling from the said base and by pressing a little bit to the loading position. The arrangement according to the invention tilts the stretcher base 10 when it is further transferred from the situation of the FIG. 3 in such a way that the turning movement of the arms 4 and 5 increases. A vertical elevation adjustment bar 7 that is mounted in bearings to be sliding at the end of the arm 5 belongs to the second arm 5 to the lower end of which elevation adjustment bar 7 a horizontal balk that supports the stretcher base 10 is adjusted. When the turning movement of the arms 4, 5 increases from the position of the FIG. 3 the elevation adjustment bar 7 begins to move down lower at the end of the arm 5 due to the fact that another bar being force control element 6 is attached to the extension arm 8 attached to the upper end of the elevation adjustment bar 7 the upper part of which bar is attached to the extension arm 8 with the help of a hinge and the lower part is attached to the arm 5 with the help of a hinge. In the position of the FIG. 3 the force control element 6 is positioned nearly vertically in which case the elevation adjustment bar 7 is essentially in the upper position. When the arms 4 and 5 according to the FIG. 4 are more turned and the stretcher base 10 maintains its direction due to the choice of lengths of the arms 4, 5 the force control element 6 is turned to a diagonal position and has pulled at the same time the elevation adjustment bar 7 to a lower position by force. Due to this the stretcher base 10 is tilted to an advantageous loading position.

A movable carriage 9 that is on top belongs knowingly to the stretcher base 10 that helps during the loading process of the patient stretcher in which case the loading can be performed outside the vehicle. The moving of the stretcher base 10 with the load to the vehicle becomes easier when a gas spring is installed with the elevation adjustment bar 7 in order to lighten the lifting of the base.

Also with the choosing of the lengths of the arms 4 and 5 one can have an impact on the fact that in the position of the FIG. 4 the base has a suitable direction for example in relation to the door of the vehicle or in relation of other constructions.

The arrangement is suitable for any kind of loading and moving of a platform, a tray or similar table with the load or without it from an advantageous, tilted position up in horizontal direction and further to be able to do even side movements.

The invention claimed is:

1. Arrangement for attaching a stretcher base (10), a tray, a platform or a similar support to a wall with the help of two turning arms (4), (5) each of the arms being attached to the mentioned wall with the help of their own attachment fixtures (2), (3) in which case the mentioned stretcher base can be moved with the help of the arms (4), (5), characterized in that the stretcher base can be moved outwards from the wall in horizontal direction at the first stage of the moving in which case the first arm (4) and the second arm (5) of the arms are both hinged to be turning out of the wall in horizontal direction and the mentioned stretcher base (10) is attached to the moveable ends of the arms (4), (5) and that in the arrangement when the moving of the base (10) sideways is further continued, an elevation adjustment bar (7) belonging to the second arm (5) and sliding in the height direction is arranged to slide downwards and at the same time to set the support elements of the stretcher base (10) lower at the location of the second arm (5) in order to achieve a tilted position for the stretcher base (10).

2. Arrangement according to the claim 1, characterized in that by the elevation adjustment bar (7) there is a gas spring or an alleviation spring that has an effect on lifting the elevation adjustment bar (7) upwards.

3. Arrangement according to the claim 1, characterized in that by the second arm (5) there is a force control element (6) that controls the lowering of the elevation adjustment bar (7) when the arm (5) turns.

4. Arrangement according to the claim 1, characterized in that a force control element (6) is attached with a hinge attachment at its ends both to second arm (5) and to the elevation adjustment bar (7) or to its extension arm (8).

5. Arrangement according to the claim 1, characterized in that a convex track or a line that comes downwards functions as the force control element which track or a line one part of the elevation adjustment bar (7) is attached to follow when it turns.

6. Arrangement according to the claim 1, characterized in that the first (4) and the second arm (5) are organised in relation to their length and the locations of the hinge attachments to the wall (1) in such a way that the stretcher base (10) has the same direction as the wall essentially in the nearest position and has the same direction as the wall also in one position being pulled out of the wall.

7. Arrangement according to the claim 1, characterized in that the first (4) and the second arms (5) are arranged in relation to the wall (1) regarding their lengths and the locations of the hinge attachments in such a way that the stretcher base (10) deviates from the direction of the wall when it is in the tilted position.

8. Arrangement according to the claim 1, characterized in that the turning of the arms (4), (5) can be locked to extreme positions and at least to one mid position.

* * * * *